US006264161B1

(12) United States Patent
Waggoner

(10) Patent No.: US 6,264,161 B1
(45) Date of Patent: Jul. 24, 2001

(54) PORTABLE MUSIC STAND

(76) Inventor: W. Robert Waggoner, N4249 Sawyer Creek Rd., Shell Lake, WI (US) 54871

( * ) Notice: Subject to any disclaimer, the term of this patent is extended or adjusted under 35 U.S.C. 154(b) by 0 days.

(21) Appl. No.: 09/477,106

(22) Filed: Jan. 4, 2000

(51) Int. Cl.[7] ..... A47B 97/04

(52) U.S. Cl. ..... 248/460; 248/461; 248/441.1; 248/188.6

(58) Field of Search ..... 248/441.1, 460, 248/461, 462, 463, 188.6

(56) References Cited

U.S. PATENT DOCUMENTS

| | | | | |
|---|---|---|---|---|
| 245,020 | * | 8/1881 | Rushforth | 248/461 |
| 489,518 | * | 1/1893 | Ambruster | 248/448 |
| 2,156,489 | | 5/1939 | Bonetti . | |
| 2,474,532 | | 6/1949 | Kitchen . | |
| 2,481,264 | | 9/1949 | Tulowiecki . | |
| 4,300,743 | * | 11/1981 | Morris | 248/441.1 |
| 4,471,933 | | 9/1984 | Nelson | 248/461 |
| 4,958,577 | | 9/1990 | Demaio et al. | 108/43 |
| 5,037,057 | * | 8/1991 | Andrews | 248/460 |
| 5,114,111 | * | 5/1992 | Andrews | 248/460 |
| 5,607,135 | | 3/1997 | Yamada | 248/456 |
| 5,692,719 | * | 12/1997 | Shepherd | 248/460 |
| 5,713,553 | | 2/1998 | Cooper | 248/461 |
| 5,791,624 | * | 8/1998 | Fedrick | 248/460 |
| 5,884,566 | | 3/1999 | Chen | 108/67 |

OTHER PUBLICATIONS

Estien Folding Music Stand, Advertisement, product sold by Atelier d'Estein, France, shown in SHAR Spring/Summer 2000 catalogue, p. 57.

Nilton Magic Stand System, Advertisement, product shown in SHAR Spring/Summer 2000 catalogue, p. 56.

Gig Stand, Wenger Music Stand, Advertisement.

* cited by examiner

*Primary Examiner*—Leslie A. Braun
*Assistant Examiner*—Gwendolyn Baxter
(74) *Attorney, Agent, or Firm*—Larkin, Hoffman, Daly & Linggren, Ltd.; Frederick W. Niebuhr, Esq.

(57) ABSTRACT

A portable music stand includes a panel assembly composed of hinged elongate panel sections, two spaced-apart elongate walls or shelves running along one of the panel sections, and opposed end walls mounted to that same panel section and to the shelves, thus to form a container with one open side. The music stand also includes a mounting assembly with a base, a telescoping column extending upwardly from the base, and a brace at the top of the column and releasably coupled to the panel assembly. When in an open, flat configuration, the panel assembly cooperates with the shelves to provide a desk to support sheet music and accessories. Alternatively, the panel sections can be pivoted to a closed position in which the panel sections are wrapped about the container to close it. The mounting assembly is collapsible into a configuration that fits inside the container, and thus can be carried within the closed container. Alternative embodiments include containers with non-rectangular profiles, and resilient panels that are closed by elastic deformation rather than by pivoting hinged panel sections.

32 Claims, 14 Drawing Sheets

34
18
32
36
30
28
42
26
38
24
16
62
22
60
40
46
20
54
58
50
44
56
52

32
72
68
48
18
66
40
64
70
62
60
46
58
50
54
52

32
30
34
28
26
72
24
36
68
42
48
64
66
38
70
78
76
74
40
62

PORTABLE MUSIC STAND

BACKGROUND OF THE INVENTION

The present invention relates to stands of the type typically used to support a musician's sheet music during musical performances and practices, and more particularly to structures of such stands that facilitate disassembly or collapsing for storage and transport of the stands between uses.

Music stands typically include a planar platform or backing, and a shelf or ledge along one edge of the platform and perpendicular to the platform. The platform is supported through a base, and a post or column coupled to the base and platform. The column/platform coupling typically is adjustable to support the platform at an incline from the horizontal, with the shelf extending upwardly and away from the platform in the shelf width direction. Consequently, sheet music lies against the platform with its bottom edge supported by the shelf. While this type of stand most frequently is used by musicians, it also can be used during presentations to support books, sheets of paper and other materials.

One popular music stand features an open-frame construction in which the platform, shelf, column and base are combined in a single, collapsible framework. These stands, while useful in certain circumstances, are light weight and tend to be unstable, particularly when required to support booklets or multiple sheets of music rather than single sheets. Alternatively, the most common music stands of more stable construction are difficult to transport and store.

The prior art includes examples of attempts to impart more stability to more portable music stand designs. For example, U.S. Pat. No. 2,156,489 (Bonetti) shows a music stand with opposite sides that fold into a case when removed from a supporting standard. At the bottom of the standard is a heavy, single-piece base. The base and standard fit into one side of the case.

U.S. Pat. No. 5,713,553 (Cooper) describes a portable stand with a rack formed of opposite side members, each pivotally connected to an upright central spine. The spine is hollow, and includes a closed end and an opposite end with a snap-lock door. Inside the spine is a yoke for mounting the rack pivotally on a telescoping post. At the bottom of the post is a housing that supports three pivoting legs. The post and legs are collapsible to fit within the spine. A somewhat similar design is shown in U.S. Pat. No. 2,481,264 (Tuloweicki). In this design, cover sections on opposite sides of a central plate are hinged to the plate. A compartment behind the plate, or at the bottom of a case formed by the cover sections when closed, stores a telescoping stand and collapsible legs.

U.S. Pat. No. 4,471,933 (Nelson) discloses a music stand with a tray which, together with a support post, fits into a box-like base and cooperates with the base to form an enclosure. U.S. Pat. No. 2,474,532 (Kitchen) shows a combination loose-leaf binder and music stand table.

While having some utility, these satchel or briefcase designs remain relatively large and cumbersome in their storage/transport configurations. They frequently incorporate extra components necessary for storage or closure but having no utility in connection with use in the open configuration as a music stand. In some cases these closure components detract from use, as with rims or flanges along the side edges or upper edges of the music supporting platform, as seen in the Cooper, Tuloweicki and Nelson patents.

Another problem associated with music stands, whether or not portable, is the lack of a capacity to accommodate accessories, e.g. reeds for woodwind instruments, pencils, markers, and valve oil, which the musician may use during a performance or practice. When placed on the shelf supporting sheet music, such accessories tend to interfere with use of the sheet music, and can be knocked off the shelf when a sheet or page is turned. As a result, needed accessories frequently are kept in an instrument case, or on the floor near the music stand, and thus are not as conveniently accessible.

Accordingly, it is an object of the present invention to provide a portable stand that is structurally sound and stable when configured for use, and is collapsible into a smaller, more easily stored and transported package when not in use.

Another object is to provide a portable stand design that minimizes the number of components useful only in a collapsed, storage configuration of a stand having alternative configurations for storage and use.

A further object is to provide a portable music stand expandable into an open setting for use and alternatively a closed setting for storage or transport, with enhanced utility in the open configuration.

Yet another object is to provide an improved process for stowing a portable stand.

SUMMARY OF THE INVENTION

To achieve these and other objects, there is provided a portable stand. The stand includes a support structure adapted to assume a substantially planar configuration to provide a platform. An elongate first wall runs lengthwise in a longitudinal direction along one edge of the platform. An elongate second wall runs lengthwise along the platform and extends from the platform in proximal, transversely spaced-apart relation to the first wall. The first wall, second wall and a portion of the support structure between the walls cooperate to provide a container having an open side opposite that portion of the platform. The support structure further is adapted to assume a surrounding engagement with the container to close the open side. The stand further includes a mounting structure adapted to support the platform inclined from the horizontal, whereby the one edge of the platform forms its lower edge, and the first and second walls are disposed proximate the lower edge and extend transversely and upwardly away from the platform.

Preferably the portable stand further includes first and second laterally disposed end closure members integral with the support structure and disposed at opposite ends of the first and second walls. The lateral end closure members are adapted to close the opposite ends of the container when the support structure surrounds the container.

In a preferred construction the support structure comprises a plurality of elongate panels. Each panel has a longitudinal panel length and a lateral panel width. The panels are arranged side by side and coupled rotatably to provide for a pivoting of adjacent panels relative to one another about longitudinal axes. In this case, when the support structure surrounds the container it forms an elongate cylinder that extends longitudinally and is polygonal in lateral cross section. Adjacent panels can be shaped to allow pivoting in only one direction from the planar configuration, to stabilize the platform.

In a particularly preferred embodiment, the walls are perpendicular to the platform and the container when closed is rectangular in lateral cross section. The resulting container can be, for example, about thirty inches long by about three inches in width and depth, thus providing a shape that occupies a relatively small volume (270 cubic inches) and is well suited for packing multiple portable stands.

In alternative approaches the container may form non-rectangular polygons, e.g. hexagons or triangles, also exhibiting advantageously low storage volumes.

The first and second walls, in addition to containing the collapsed mounting structure in storage, provide useful upper and lower shelves. When the portable stand is in use, the upper shelf cooperates with the platform to support the sheet music. Meanwhile, a variety of accessories such as pencils, reeds, and valve oil can be placed on the lower shelf where they are conveniently available to the musician, do not interfere with turning pages of the music, and are not disturbed when pages are turned.

Thus the walls, like the support structure, serve a useful purpose regardless of whether the portable stand is in use or closed for storage. This arrangement keeps to a minimum the number of components that are useful only for storage.

The preferred mounting structure includes a base, a telescoping column extending outwardly from the base, and a brace mounted pivotally to an upper end portion of the column and adapted for a removable coupling to the support structure. The brace advantageously includes a pair of brace sections moveable between an extended configuration for the removable coupling, and a collapsed configuration against the column. The base can include a plurality of legs, each moveable between an extended position for supporting the column and a collapsed position against the column.

In conjunction with the portable stand, another aspect of the present invention is a process for stowing the stand, including:

a. disconnecting the mounting structure from the support structure;

b. collapsing the mounting structure into a stowage configuration;

c. placing the mounting structure, when in the stowage configuration, on the platform adjacent the first wall; and d. with the mounting structure so placed, turning the support structure about at least one longitudinal axis to form a containment structure at least partially surrounding the mounting structure and the first shelf to maintain the mounting structure proximate the first wall.

Thus in accordance with the present invention, a portable stand is more easily collapsed into a closed configuration for transporting or storing the stand. Virtually all components other than the mounting assembly serve useful purposes, not only during a practice or performance, but also when the stand is closed for transport or storage. The same walls that form opposite sides of a container when the stand is closed, also provide shelves for sheet music and accessories when the stand is used. In one preferred approach, the assembly of elongate, hinged, side-by-side panels alternatively forms a sturdy container for the collapsed mounting assembly, and a stable platform for supporting sheet music or other materials.

IN THE DRAWINGS

For a further appreciation of the above and other features and advantages, reference is made to the following detailed description and to the drawings, in which.

DETAILED DESCRIPTION OF THE PREFERRED EMBODIMENTS

Figure 1:
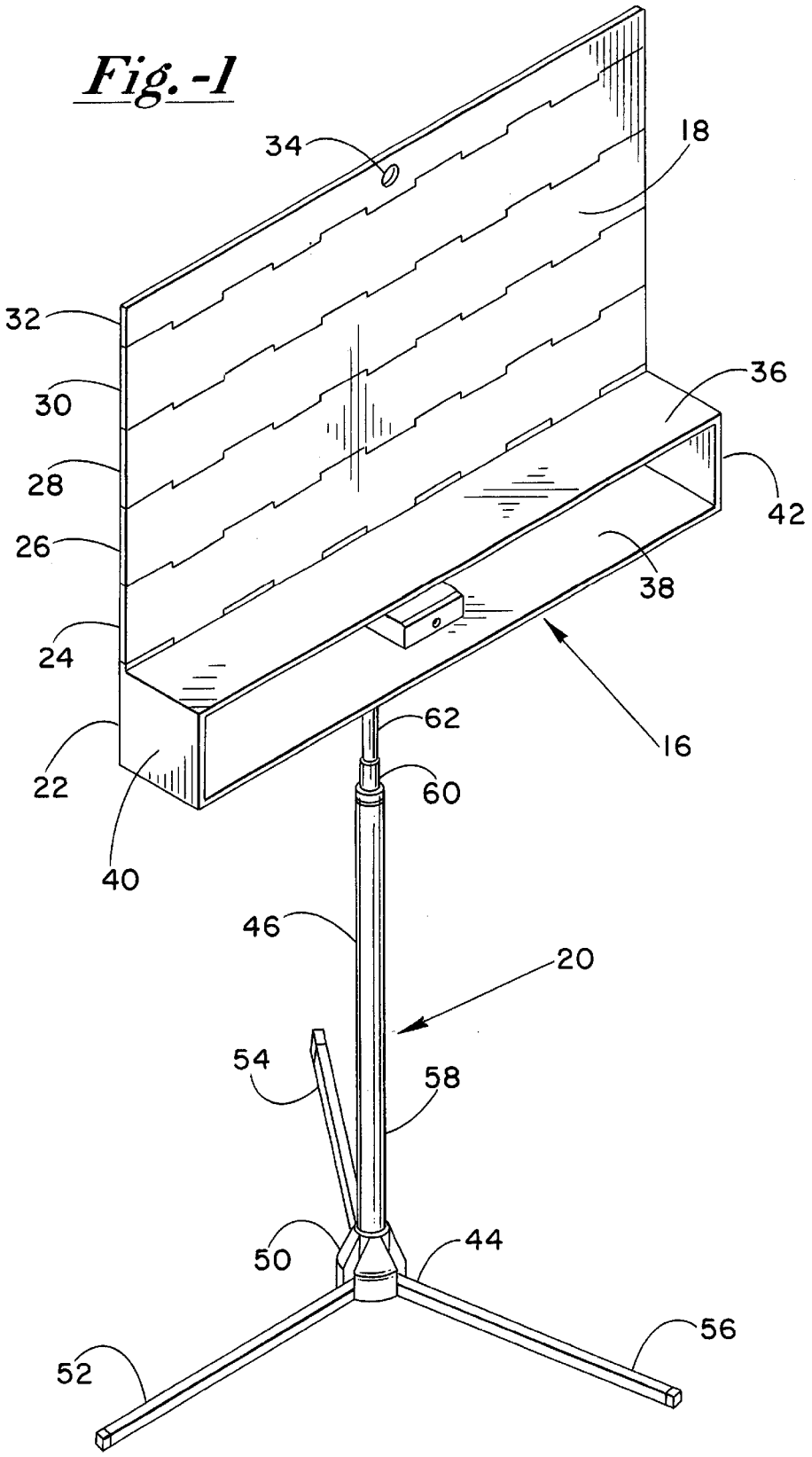
FIG 1 is a prospective view of a portable music stand constructed in accordance with the present invention.
Figure 2:
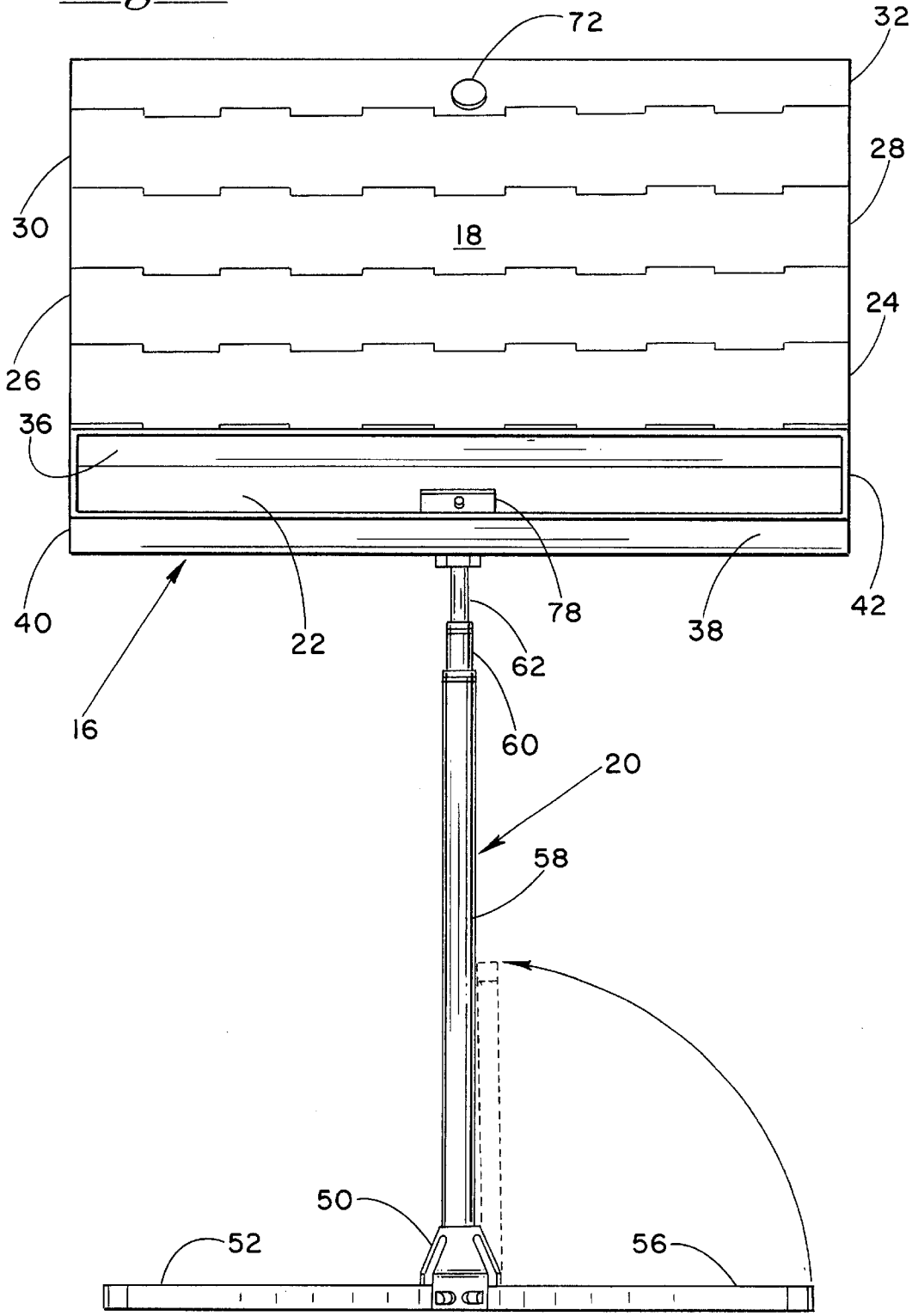
FIG. 2 is a front elevation of the music stand.
Figure 3:
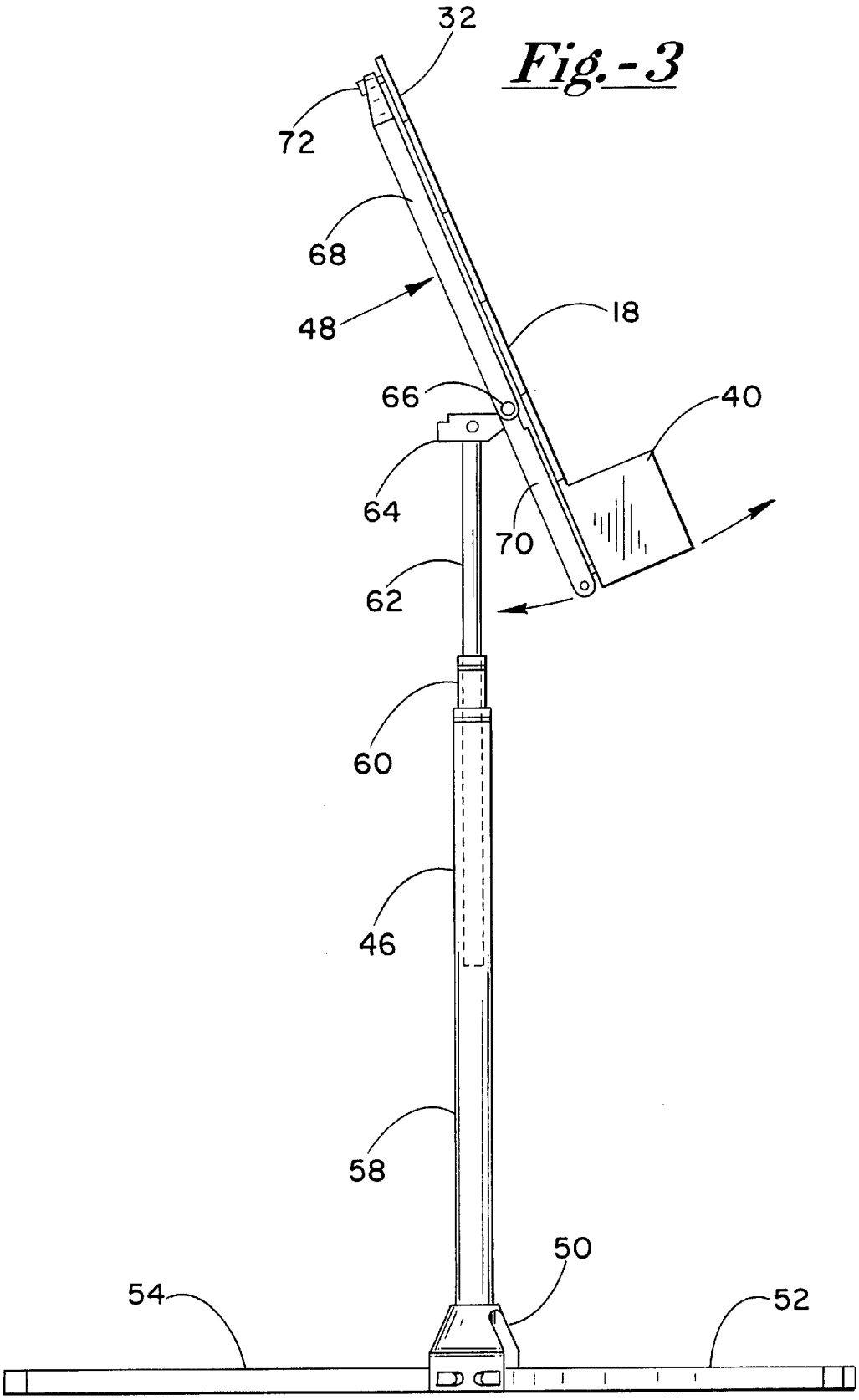
FIG. 3 is a side elevation of the music stand.

Turning now to the drawings, there is shown in FIGS. 1–3 a portable music stand 16. In these figures, the stand is shown in the open position, ready for use.

Music stand 16 has two major components: a panel assembly or desk 18 for supporting sheet music and other items, and a mounting assembly 20 for supporting the desk. The mounting assembly is adjustable to allow the musician to position the desk at a desired height.

The desk or panel assembly consists of several panels, including a proximal panel 22 which is the bottom panel when the assembly is open as shown, several intermediate panels 24, 26, 28, and 30, and a distal panel 32 which is the top panel when the music stand is in use. Adjacent panels are mounted pivotally relative to one another about longitudinal axes, i.e., axes that are horizontal as viewed in FIG. 2. The pivotal mounting permits arranging the panels in an open setting as shown in FIGS. 1–3, in which panels 22–32 are coplanar and cooperate to form a platform suitable for supporting sheet music. Each panel is elongate, having a length l and a width w as shown in FIG. 2. Panels 22–32 preferably are uniform in length, but need not be uniform in their widths. With particular reference to panel assembly 18, top panel 32 is narrower than the other panels. The distal panel has a central opening 34, for reasons to be explained.

Several walls, some of which serve also as shelves, are mounted integrally to proximal panel 22. These include an upper wall 36, a lower wall 38 spaced apart and parallel to the upper wall, and two opposed end walls 40 and 42. When the music stand is in use, upper wall 36 serves as an upper shelf for supporting sheet music. Shelf 36 preferably is of sufficient depth (e.g., 2.5 inches) to support items of greater thickness, e.g., a thick folder or stack of sheet music.

Lower wall 38 provides a lower shelf having the same length and depth as the upper shelf. Lower shelf 38 provides a convenient place for storing pencils, reeds and other accessories.

As best seen in FIG. 3, the desk or panel assembly preferably is oriented to incline the plane of the panels slightly from the vertical. Upper and lower shelves 36 and 38, extending laterally away from the panels and more particularly normal to the plane of the panels, are slightly inclined from the horizontal, thus to more securely retain sheet music and accessories.

Mounting assembly 20 includes a base 44, a telescoping column or stalk 46 extending upwardly from the base, and a brace 48 (FIG. 3) mounted to the upper end of the column. Base 44 consists of a central support member 50 constructed of solid metal or otherwise given substantial weight, and three equally angularly spaced apart feet 52, 54 and 56 extending radially outwardly from the support member. The feet are pivotal relative to the support member, and also are adapted to be locked into the support position shown in FIGS. 1–3.

Stalk 46 consists of three telescoping sections, a lower column section 58, a medial section 60 and an upper column section 62. Mounted at the top of upper section 62 is a bracket 64 that supports brace 48 in a manner that allows pivoting of the brace.

Figure 4:
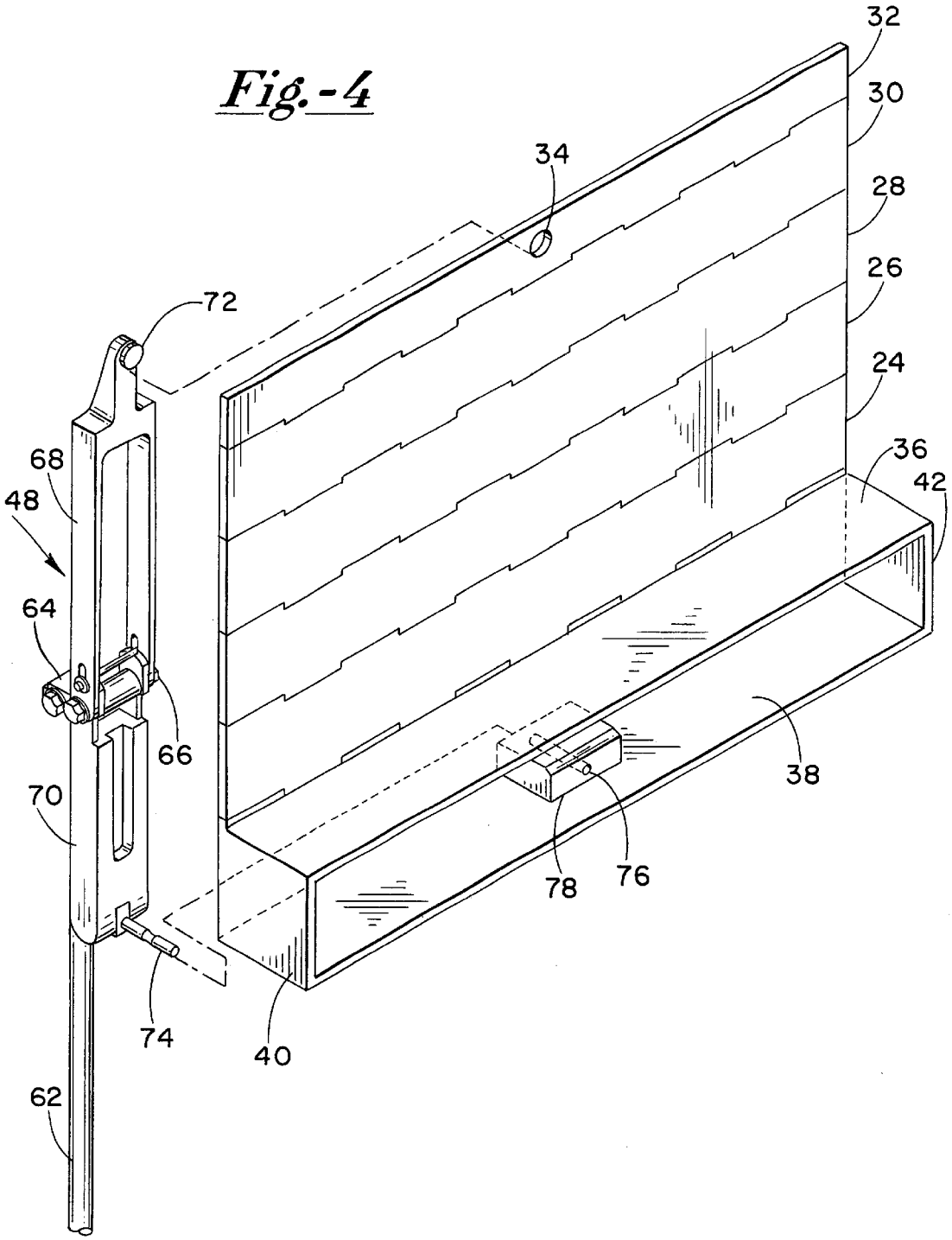
FIG. 4 is a composite perspective view showing a desk and a brace of the music stand, separated from one another.
Figure 5:
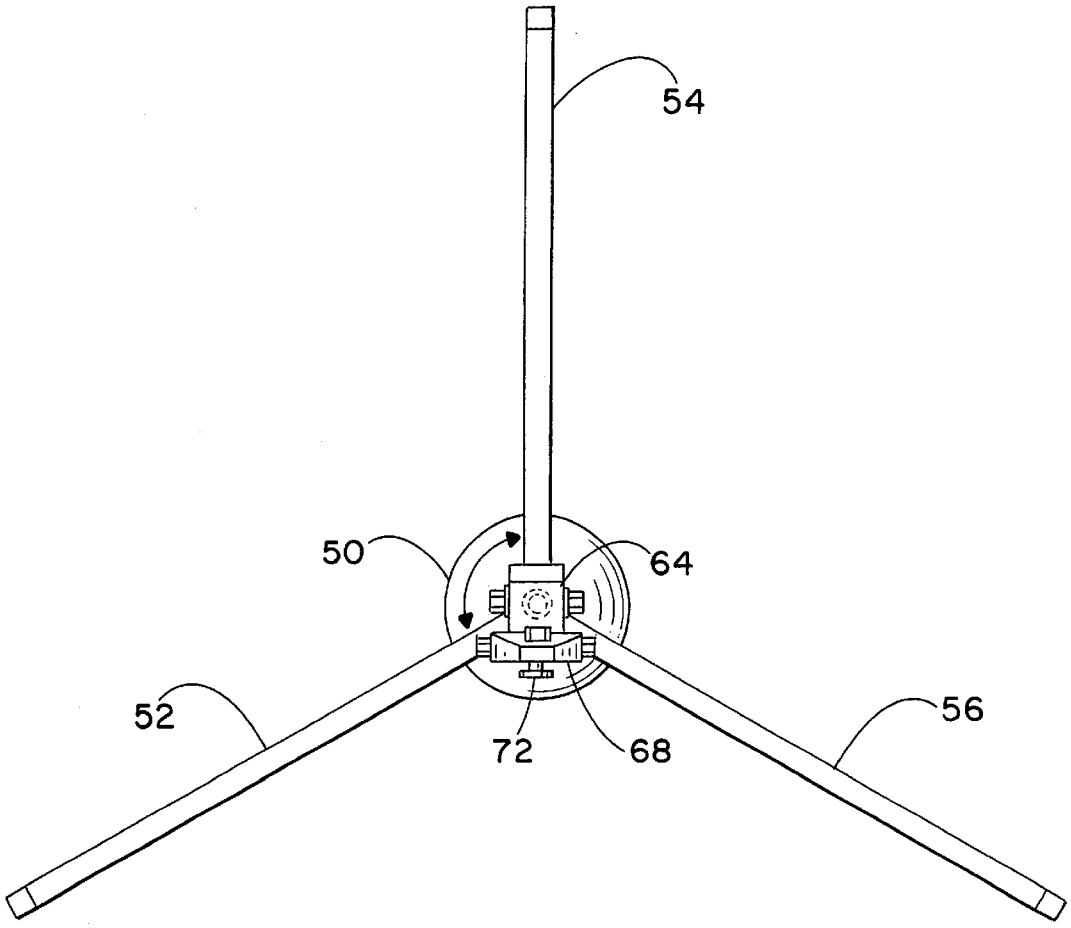
FIG. 5 is a top plan view of a mounting assembly of the music stand.

As indicated in FIG. 4, the panel assembly is coupled to the brace in a manner that allows its removal from the brace. The mounting assembly, including the brace, stalk and base, is shown in FIG. 5 in top view, separated from the panel assembly.

Figure 6:
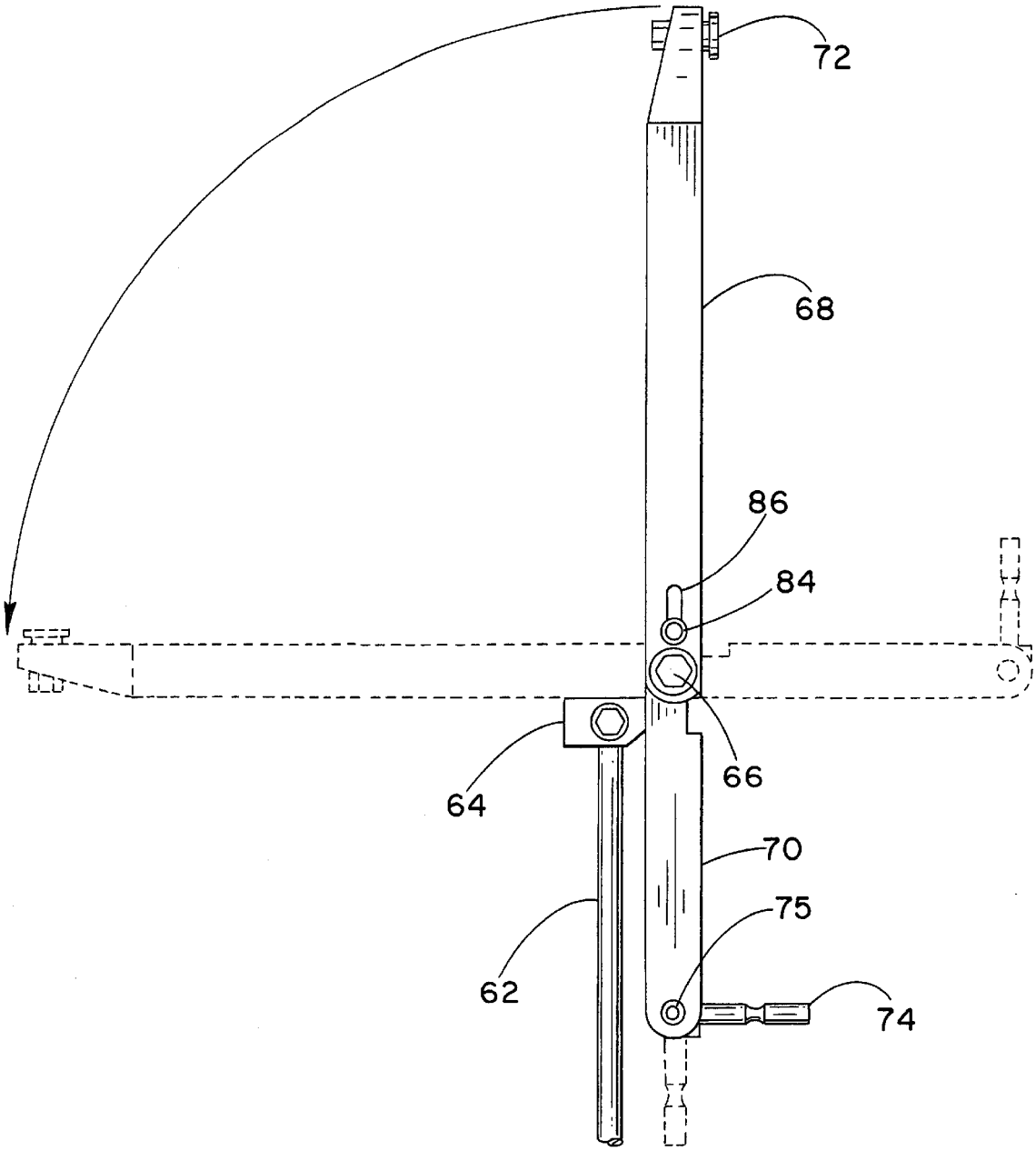
FIG. 6 is a side elevation of the brace.
Figure 7:
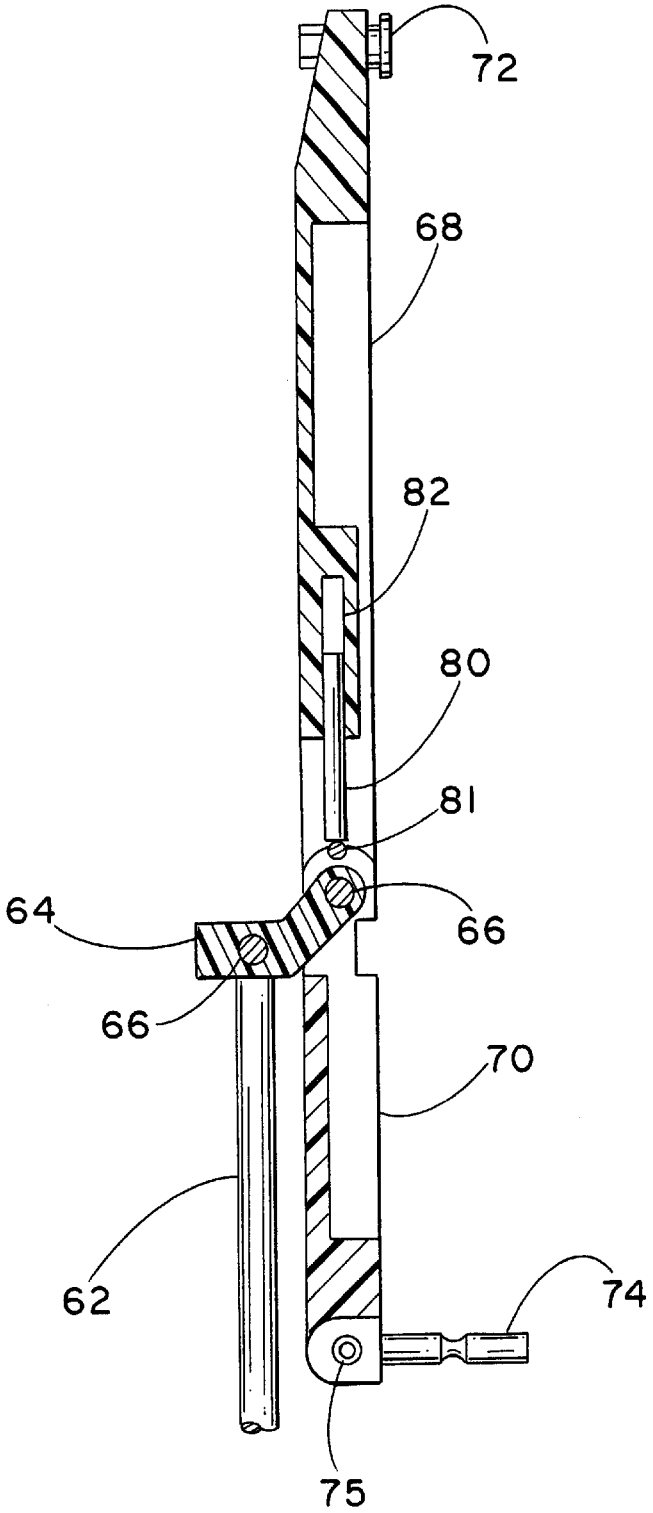
FIG. 7 is a side view of the brace in section.

As seen in FIGS. 6 and 7, brace 48 is supported by bracket 64 through a pivot pin 66 that permits rotation of the brace, relative to upper column section 62 and bracket 64. The brace includes an upper brace section 68 and a lower brace section 70. At the top of brace section 68 is a panel retaining member 72 that fits through opening 34 in distal panel 32, to help secure the panel assembly relative to the brace. A retaining pin 74, pivotally mounted to the lower end of brace section 70 through a pin 75, is removably insertable into an opening 76 within a retainer 78 mounted to lower shelf 38. Thus, retaining member 72 and retaining pin 74 cooperate to releasably mount the panel assembly to the brace.

Figure 8:
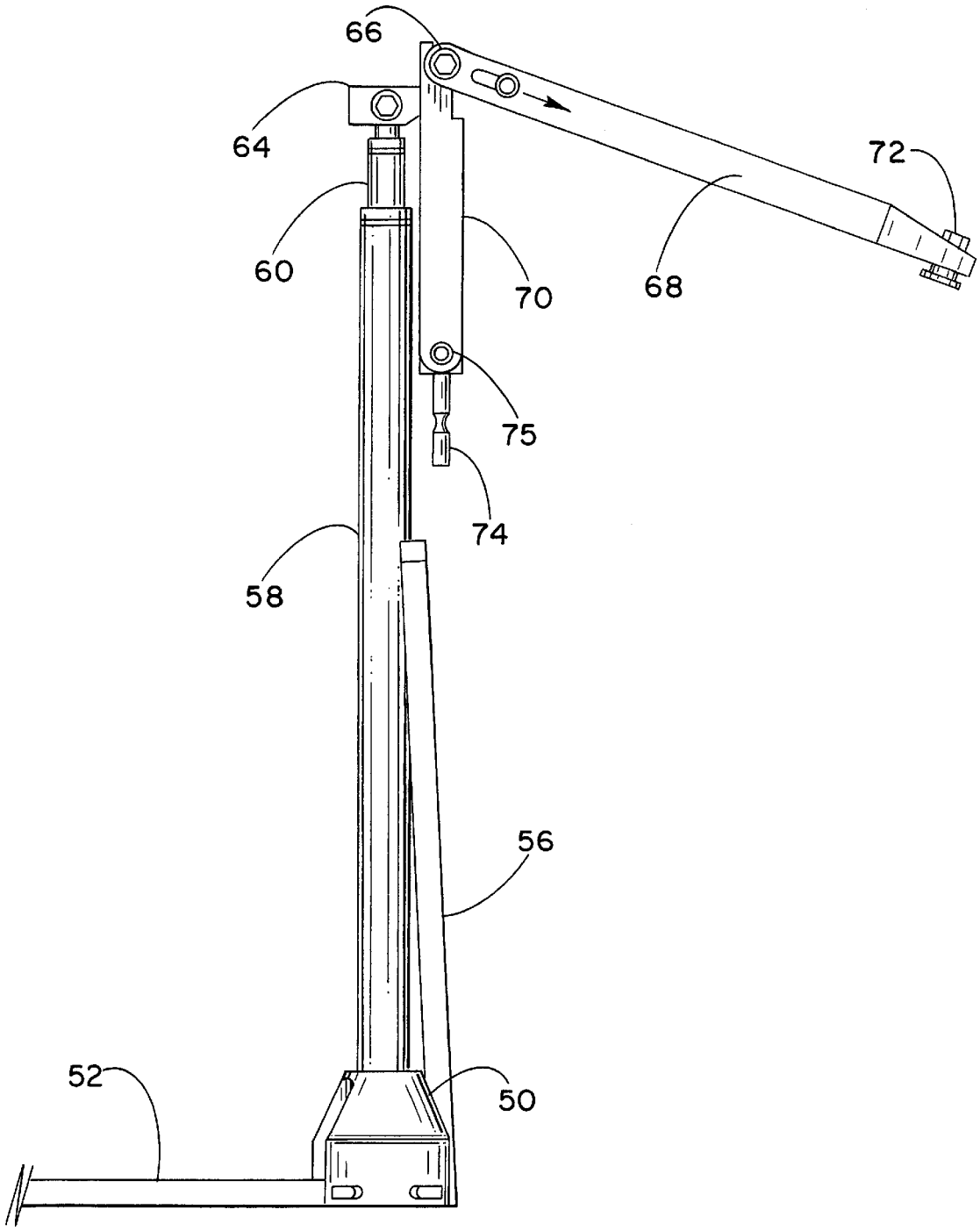
FIG. 8 is a side elevation of the mounting assembly, partially collapsed.
Figure 9:
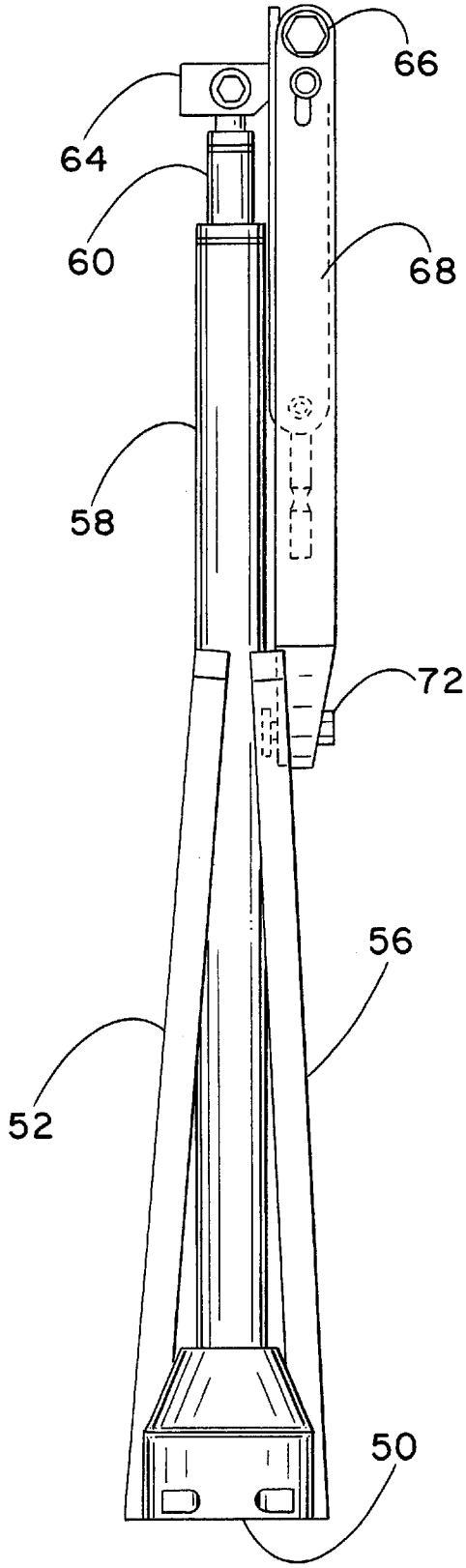
FIG. 9 is a side elevation of the mounting assembly, completely collapsed.

As best seen in FIG. 7, brace 48 is releasably maintained in the open position by a spring loaded latch pin 80 slidably mounted within an opening 82 in brace section 68, and urged against an opening 81 in brace section 70. A button 84 (FIG. 6), integral with the latch pin and extending through a slot 86 in the upper brace section, can be manipulated to withdraw the latch pin upwardly as viewed in FIG. 7, to release lower brace section 70 for pivoting relative to the upper brace section. As seen in FIG. 8, this allows a pivoting of the brace sections to collapse the brace into a folded or closed position, seen in FIG. 9. FIGS. 8 and 9 also illustrate the manner in which feet 52–56 can be pivoted from their horizontal supporting positions, to substantially vertical collapsed positions against lower column section 58. In addition, medial section 60 and upper section 62 are shown moved in telescoping fashion downwardly into lower column section 58, to minimize the height of the stalk.

Figure 9A:
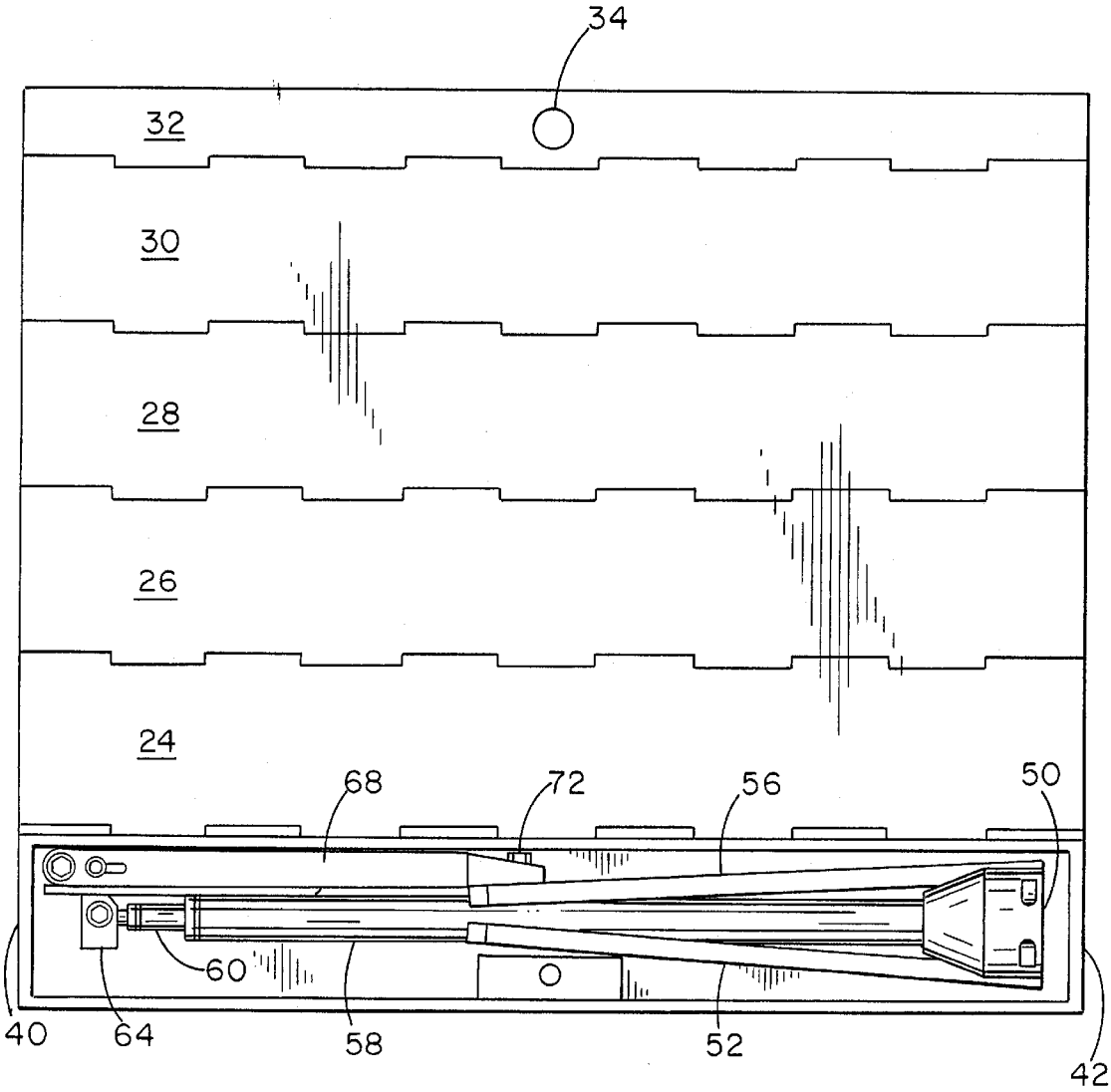
FIG. 9A is a front elevation of the desk, showing the collapsed mounting assembly in a container formed by the desk.

As viewed in FIG. 9, mounting assembly 20 has assumed a stowage configuration, in which the mounting assembly is diminished in size sufficiently to fit within a container formed by proximal panel 22, upper wall 36, lower wall 38, and end walls 40 and 42. This permits a stowing of the music stand in the following manner. First, the desk or panel assembly is disconnected from the brace, as indicated in FIG. 4. Then, the mounting assembly or structure is collapsed into the stowage configuration shown in FIG. 9, and placed inside a container 88 formed by the panel and walls of the panel assembly, as shown in FIG. 9A.

Next, the panel assembly is turned about the container, specifically by rotating the panel sections about respective longitudinal axes. This pivoting proceeds in succession beginning with intermediate panel 24, first to position that panel against upper wall 36. Next, intermediate panel 26 is pivoted until it is parallel with proximal panel 22 and closes the container. Then, intermediate panel 28 is pivoted to lie against lower wall 38, followed by a pivoting of intermediate panel 30 to a position against proximal panel 22. Finally, distal panel 32 is pivoted to overlie intermediate panel 24. The result is a closed container 88, shown in FIG. 10.

To facilitate carrying the container, a handle can be provided in the form of a strap, e.g. a one-inch wide nylon webbing, attached to the opposite ends of the container, specifically to end walls 40 and 42. The strap (not shown) can be slightly longer than the container to allow carrying the container by hand. Alternatively, a much longer strap can be used as a shoulder strap. In yet another alternative, a strap of sufficient length to function as a shoulder strap can be adjustable to a shorter length to facilitate carrying the container by hand.

Figure 10:
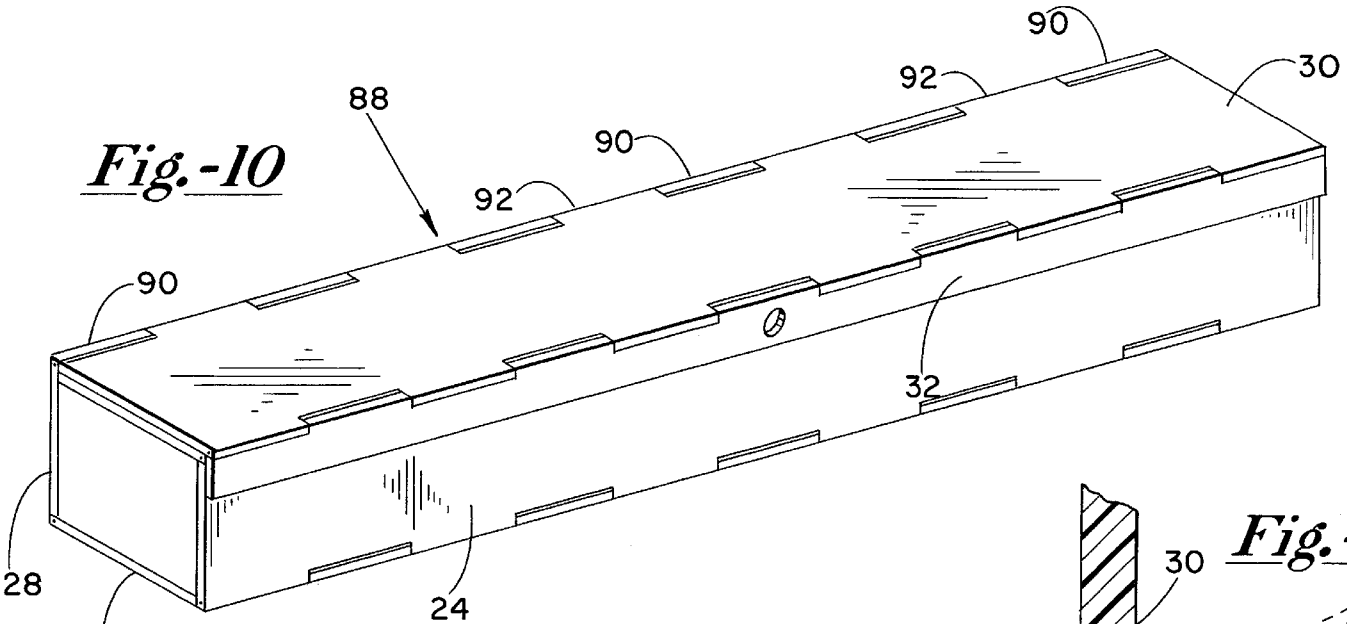
FIG. 10 is a prospective view of the desk of the music stand, with the panel sections of the desk pivoted into a closed-container configuration.

Pairs of adjacent panel sections, particularly along their common longitudinal axes, are configured in a manner that facilitates their pivoting to the closed position shown in FIG. 10, and alternatively positions the panels in the planar configuration for providing desk 18 shown in FIGS. 1–3. With reference to intermediate panel sections 28 and 30, it is seen in FIG. 10 that panel section 28 includes a series of hinge extensions 90, dovetailed with a series of hinge extensions 92 of panel section 30. All of the hinge extensions have longitudinal openings, and a hinge pin 94 extending longitudinally through the openings secures panel sections 28 and 30 to pivot relative to one another.

Figure 12:
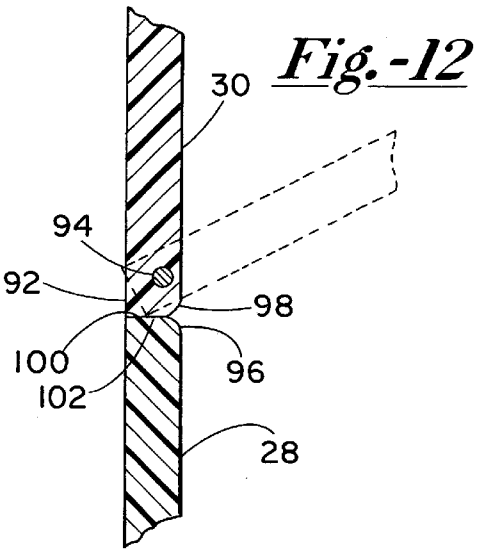
FIG. 12 is a sectioned view similar to FIG. 11, showing the panel sections in the open position.
Figure 11:
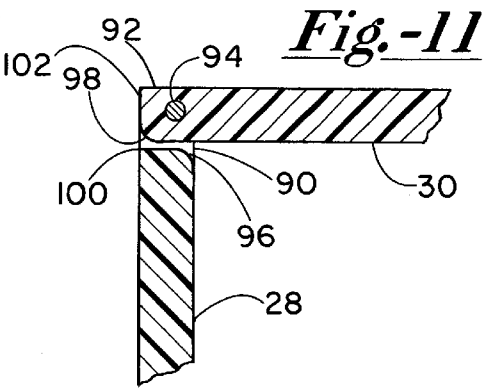
FIG. 11 is a partial sectional view showing two of the panel sections in the closed position.

As seen in FIG. 11, portions of hinge extensions 90 and 92 are cut away to form in each hinge extension a curved region, illustrated at 96 and 98 for hinge extensions 90 and 92, respectively. The curved regions allow pivoting of panel sections 28 and 30 relative to one another, from the closed position shown in FIG. 11 to the open position shown in FIG. 12. At the same time, however, respective planar surfaces 100 and 102 of hinge extensions 90 and 92 engage one another when the panel sections are open as shown in FIG. 12, to prevent any further counterclockwise rotation of panel section 30 beyond the open setting. Alternatively, planar edges or surfaces 100 and 102 can be thought of as allowing rotation of the intermediate panel sections in only one direction away from the open setting. In FIG. 12, the one direction for intermediate panel 30 is clockwise, while for panel section 28 the direction is counterclockwise.

The other adjacent pairs of panel sections are pivotally coupled in the same manner.

Figure 13:
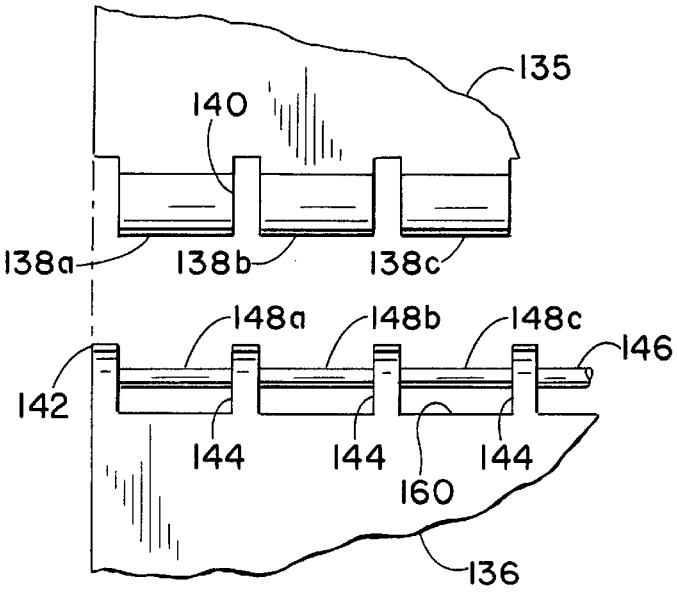
FIG. 13 is a front elevation showing portions of two spaced apart, confronting panels of an alternative embodiment music stand.
Figure 14:
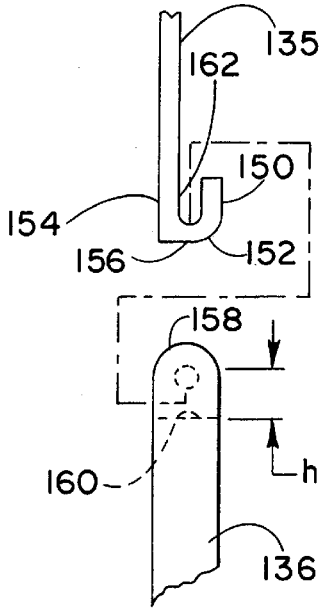
FIG. 14 is a side view of the panels shown in FIG. 13.

FIGS. 13 and 14 show portions of two panel sections 135 and 136 of an alternative embodiment music stand. The panel sections are shown spaced apart from one another to illustrate an alternative hinge design. Along its edge that confronts the other panel, i.e. the lower edge as viewed in FIGS. 13 and 14, panel section 135 includes a series of hook-like extensions 138*a*, 138*b*, 138*c*, etc. Adjacent extensions 138 are spaced apart longitudinally from one another to define a series of gaps 140.

The upper or confronting edge region of panel section 136 includes two end supports, one of which is shown at 142, and a series of intermediate supports 144 spaced apart along the panel edge. Maintained in spaced-apart relation to the rest of the panel section is a bar 146 consisting of sections 148*a*, 148*b*, 148*c*, etc., one section between each pair of the supports. When panel sections 134 and 136 are properly aligned as shown, bar sections 148 confront hook-like extensions 138, and supports 142/144 confront gaps 140.

As best seen in FIG. 14, panel section 135 and the hook-like extensions define a J-shaped profile. Each extension 138 includes a remote segment 150 substantially parallel to panel section 135, an arcuate segment 152, and a proximal segment 154 that defines a flat surface 156. Each support 142/144 of panel section 136 has an arcuate upper surface, as indicated at 158 in connection with end support 142. The supports extend upwardly from a flat edge 160 of panel section 136, which is horizontal as viewed in FIGS. 14 and 15. The letter "h" in FIG. 14 indicates the distance between flat edge 160 and the center of bar 146.

Figure 15:
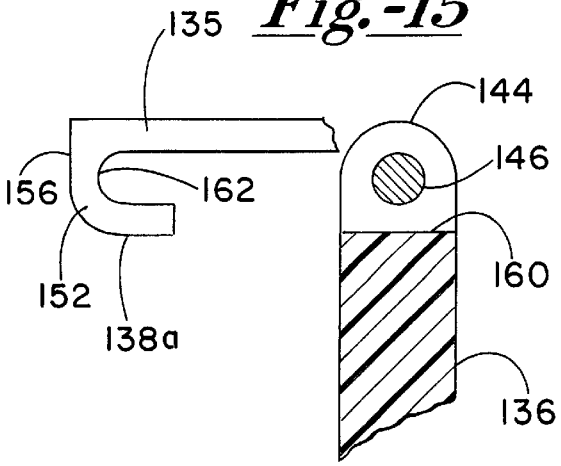
FIGS. 15 and 16 are side views, shown in section, illustrating a snap-fit assembly of the panels.
Figure 16:
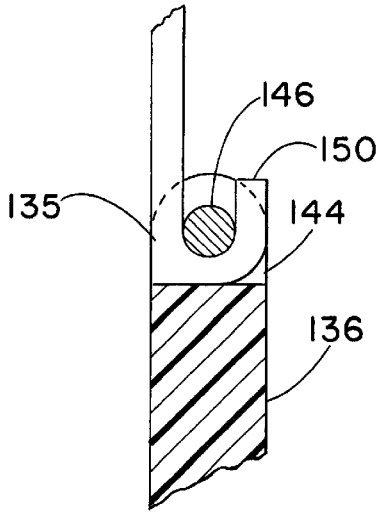

The coupling of panel sections 135 and 136 is illustrated in FIGS. 15 and 16. Before coupling, the panel sections are juxtaposed perpendicular to one another as shown in FIG. 15. The thickness of remote segment 150 (vertical dimension as seen in FIG. 15), and the radial thickness of arcuate segment 152, are substantially the same as but slightly less than the distance from the bottom of bar 146 to flat edge 160. This permits a sliding of the panel section to the right as viewed in FIG. 15, until bar 146 (specifically bar segment 148*a*) is nested within a circular opening 162 formed by extension 138*a*. The other extensions are coupled to the bar substantially simultaneously, and in the same fashion.

Panel sections 135 and 136 preferably are unitary structures made by injection molding, using a high quality plastic, and more preferably a plastic that readily undergoes elastic deformation with good elastic recovery. Then, the distance between remote segment 150 and panel section 135 at some point can be less than the diameter of bar 146. The result is a momentary elastic deformation of remote segment 150, panel section 135 or both as extension 138*a* is moved rightward, the subsequent elastic recovery resulting in a "snap" fit as bar segment 148*a* becomes captured within opening 162.

The curvature of bar segment 148*a* is substantially identical to the curvature of opening 162. Also, the radius of curvature of the radially outward surface of arcuate segment 152 is substantially equal to the distance "h" from the center of bar 146 to flat edge 160. Accordingly, coupling of the panel segments results in a hinged connection that allows pivoting of the panels relative to one another about a longitudinal axis centered on bar 146.

As best seen in FIG. 16, flat surface 156 of proximal segment 154 abuts flat edge 160, to maintain panel sections 135 and 136 in an open position of substantial coplanarity, and insure that any pivoting of panel section 135 away from the open position must occur in the clockwise direction as viewed in FIG. 16.

Figure 17:
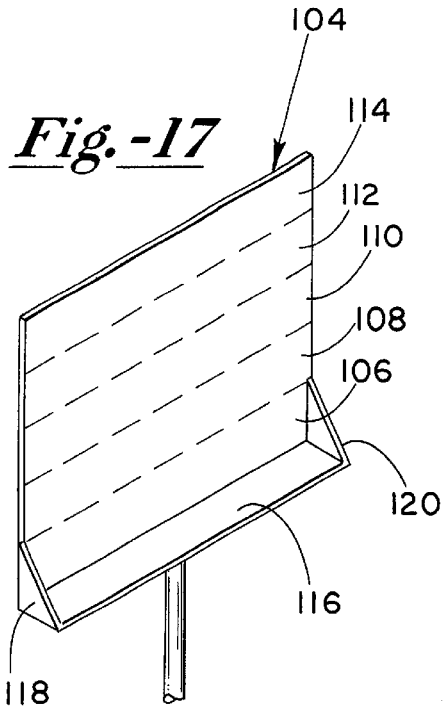
FIG. 17 is a prospective view of the desk of an alternative embodiment portable music stand.

FIG. 17 illustrates an alternative embodiment desk or panel assembly 104 including five panel sections 106, 108, 110, 112 and 114. A single wall or shelf 116 extends laterally from panel section 106, perpendicular to the panel sections. Opposed triangular end walls 118 and 120 are coupled to shelf 116 and panel 106. Panels 106–114 are pivotally coupled through hinge extensions and hinge pins as previously described.

Figure 18:
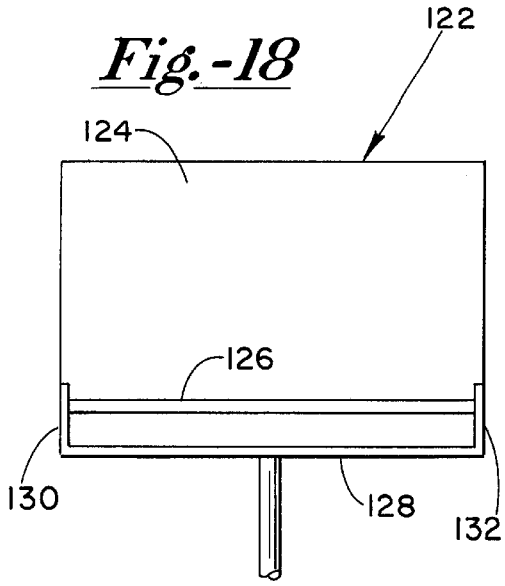
FIG. 18 is a front elevation of the desk of another alternative embodiment portable music stand.
Figure 19:
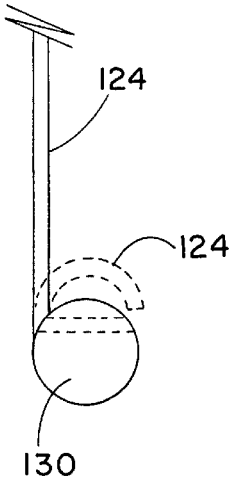
FIG. 19 is an end elevation of the desk shown in FIG. 18.
Figure 20:
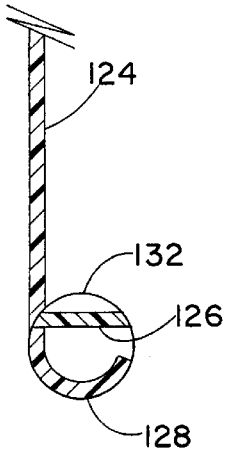
FIG. 20 is a sectioned view of the desk shown in FIG. 18.

FIGS. 18–20 illustrate a further alternative embodiment desk 122 including a single panel 124 in lieu of hinged panel sections. An upper shelf 126 extends laterally from the panel and is perpendicular to the panel. A lower shelf 128 is rounded, as best seen in FIG. 16. The shelves extend longitudinally between opposed circular end walls 130 and 132. Panel 124 is flat and thin, and preferably is formed of a resilient polymeric material. In response to the application of an external force, panel 124 can be elastically deformed to allow a wrapping about end walls 130 and 132, as indicated by the broken lines in FIG. 19. When no longer subject to an external force, the panel tends to return to its planar shape. This embodiment thus requires no hinges, but does require straps, latches or other means (not shown) to maintain the panel wrapped about the end walls or closed.

Figure 21:
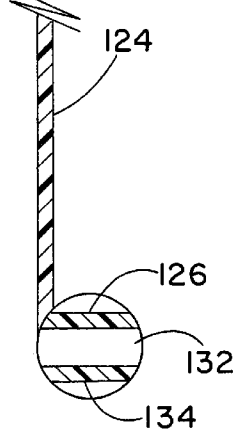
FIG. 21 is a sectioned elevation similar to FIG. 20, showing a variation of the desk shown in FIG. 18.

FIG. 21 illustrates a variation of the embodiment of FIGS. 18–20, in which lower shelf 134 is flat rather than round.

Figure 22:
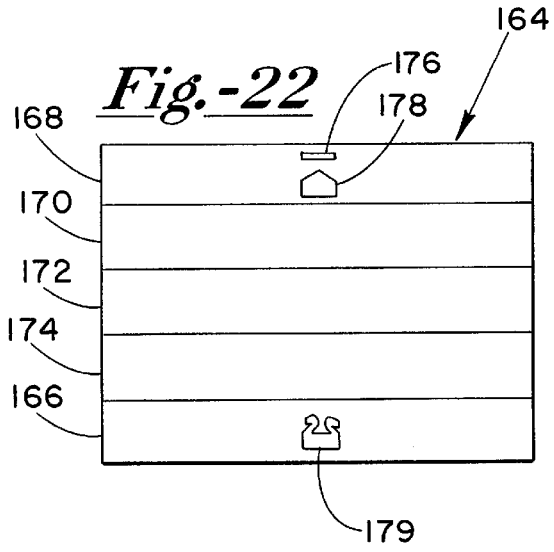
FIG. 22 is a rear elevation of the panel assembly of another alternative embodiment portable stand.

FIG. 22 is a rear elevation of a panel assembly 164, shown in the open position to provide a desk. The panel assembly includes a proximal panel section 166 at the bottom, a distal panel section 168 at the top, and three intermediate panel sections designated 170, 172 and 174.

Figure 26:
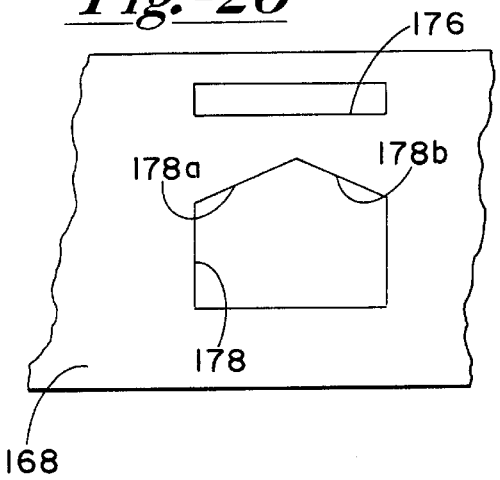
FIG. 26 in an enlarged partial view of a distal panel of the panel assembly.

With reference to FIG. 26 as well as FIG. 22, there are two openings formed through the distal panel section: an elongate rectangular slot 176, and a latch-receiving opening 178 with inclined sides 178*a* and 178*b* but otherwise rectangular.

Figure 25:
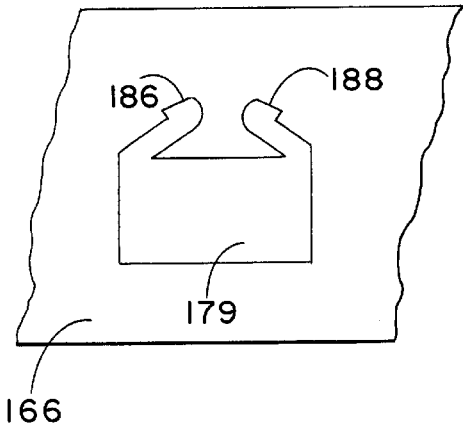
FIG. 25 is an enlarged partial view of a proximal panel of the panel assembly shown in FIG. 22.

With reference to FIGS. 22 and 25, a latch 179 is secured to proximal panel section 166, centrally along the back side of the panel section. This positions the latch on the outside of the box when panel assembly 164 is closed.

Figure 23:
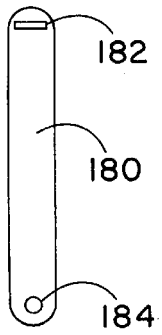
FIG. 23 is a front elevation of a brace of the alternative embodiment stand.
Figure 24:
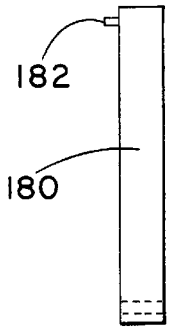
FIG. 24 is a side elevation of the brace.

FIGS. 23 and 24 show a brace 180 used to support panel assembly 164 in the open position for use, in much the same manner as brace 48 supports panel assembly 18. While brace 180 is represented somewhat schematically to emphasize the features that distinguish it from brace 48, it preferably is similar to brace 48 in terms of a collapsible or foldable construction, and the manner of attachment to the stalk. A panel assembly support bracket 182 projects outwardly from brace 180 near the top of the brace. Near the bottom of the brace is a latch-receiving opening 184, substantially identical to opening 178 in size and shape.

As best seen in FIG. 25, latch 179 includes two latching fingers 186 and 188. The latch preferably is formed of a polymeric material with favorable elastic recovery properties. As shown in FIG. 25, latch 179 is in the relaxed state, i.e., the shape it assumes when subject to no external stresses. By applying a downward (as viewed in the figure) force to the free ends of the latching fingers, latch 179 is elastically compressed in the sense of bringing the free ends of the fingers closer to the main body of the latch. When compressed in this manner, latch 179 is insertable into either one of openings 178 and 184. Further, latch 179 remains elastically deformed after insertion, providing an elastic restoring force, particularly along the locations of latching-finger attachment to the remainder of the latch, tending to maintain the latch within the opening.

To set up the stand for use, panel assembly 164 is opened to the planar configuration shown in FIG. 22, distal panel 168 is placed against the forward face of brace 180 such that bracket 182 projects through opening 176, and proximal panel 166 is pushed against the brace forward edge to urge latch 179 into opening 184. This requires compression of latch 179 as discussed above, with the result that the latch, once inserted into opening 184, tends to maintain the latch within the opening. Thus, latch 179 and bracket 182 cooperate to secure the opened panel assembly against brace 180.

A pair of walls, not shown but similar to upper and lower walls 36 and 38, are mounted integrally to proximal panel 166 and provide shelves when the panel assembly is supported in the open configuration. Panel sections 166–174 are hinged to one another as previously described, to enable closure of the panel assembly into a rectangular container. When the panel assembly is closed, intermediate panels 174, 172 and 170 are respectively aligned with the upper wall, the opening between the upper and lower walls, and the lower wall. Distal panel section 168 is aligned with proximal panel section 166, which aligns latch-receiving opening 178 and latch 179 to allow insertion of the latch into the opening. Once again, insertion requires compression of the latch, resulting in an elastic restoring force that tends to maintain the latch within the opening. Thus, latch 179 when inserted into opening 178 tends to secure the container by maintaining the panel assembly closed.

To either open the container or to disassemble the stand following use, the musician or other user removes latch 179 from its associated opening (either 178 or 184) by compressing the latch sufficiently to release it from the opening. Thus, latch 179 is conveniently insertable and removable from either of openings 178 and 184, for alternative set-up and closure of the panel assembly.

All of the embodiments provide portable stands, easily set up for supporting music or for other uses, and easily collapsed and folded into a closed configuration for convenient transport or stowage. In each case the stand can consist of two assemblies—a panel or support assembly, and a mounting assembly—to facilitate setup and takedown, and to avoid small pieces that might be misplaced or lost. The stowage volume is small, and in the case of the rectangular container is particularly well suited for packing. The weight of the support member shifts the center of gravity downward toward the base when the stand is in use, for improved stability.

What is claimed is:

1. A portable stand including:

a panel assembly including a plurality of elongate panels, each panel having a longitudinal panel length and a lateral panel width, the panels being arranged in side-by-side relation an d rotatably coupled to provide for a pivoting of adjacent panels relative to one another about longitudinal axes;

an elongate first wall extending lengthwise in the longitudinal direction along a selected one of the panels and extending lengthwise in the longitudinal direction along a direction of its width;

at least one substantially laterally disposed end closure member integral with the selected panel and the first wall, said end closure member having a lateral profile;

wherein said pivoting of adjacent panels allows alternative placement of the panel assembly in an open setting in which the panels are substantially co-planar and provide a platform, and a closed setting in which the panels, the first wall, and the at least one end closure member cooperate to form an elongate container that extends longitudinally and is polygonal in lateral cross section; wherein the panels, when in the closed setting, substantially conform to the lateral profile of the end closure members, and a mounting structure adapted to support the panel assembly in the open setting with the platform inclined from the horizontal such that the selected panel forms a lower end region of the platform, with the first wall extended laterally and upwardly away from the selected panel.

2. The portable stand of claim 1 wherein:

the mounting structure is collapsible and, when collapsed, fits inside the container.

3. The portable stand of claim 2 wherein:

the mounting structure includes a base, a column extending upwardly from the base, and a brace mounted to an upper end portion of the column and adapted for a removable coupling to the platform.

4. The portable stand of claim 3 wherein:

the brace is pivotally coupled to the column, and is moveable between an open configuration for supporting the platform and a closed configuration against the column.

5. The portable stand of claim 3 wherein:

said column is comprised of a plurality of telescoping column sections.

6. The portable stand of claim 3 wherein:

the base includes a plurality of legs moveable relative to the column between respective extended positions for supporting the column, and respective collapsed positions against the column.

7. The portable stand of claim 3 wherein:

said base and said brace are substantially permanently coupled to the column.

8. The portable stand of claim 1, wherein:

the at least one end closure member includes two end closure members mounted to opposite ends of the selected panel, for closing opposite ends of the container.

9. The portable stand of claim 1 wherein: said first wall extends away from the selected panel at a predetermined angle in the range of 45 degrees to 135 degrees.

10. The portable stand of claim 9 wherein:

said predetermined angle is approximately 90 degrees.

11. The portable stand of claim 10 wherein:

the container is rectangular in lateral cross section.

12. The portable stand of claim 11 further including:

a second elongate wall extending lengthwise along said selected panel in parallel, spaced-apart relation to the first wall, whereby the first and second walls cooperate to provide first and second opposite side walls of the container when the panel assembly is closed.

13. The portable stand of claim 12 wherein:

the at least one end closure member includes two end closure members cooperating with the selected panel and the first and second walls to form a rectangular box open along a side opposite the selected panel when the platform assembly is open.

14. The portable stand of claim 1 wherein:

adjacent ones of said panels are hinged together.

15. The portable stand of claim 14 wherein:

confronting side edges of the adjacent panels are disposed to engage one another when the panel assembly is in the open setting, and thereby limit the pivoting of adjacent panels to one direction angularly away from the open setting.

16. A portable stand including:

a support structure adapted to assume a substantially planar configuration to provide a platform;

an elongate first wall running lengthwise in a longitudinal direction along one edge of the platform;

an elongate second wall running lengthwise along the platform and extending from the platform in proximal, transversely spaced-apart relation to the first wall, said first wall, second wall and a portion of the platform between the walls cooperating to provide a container having an opening opposite said portion of the platform;

wherein the support structure further is adapted to assume a surrounding engagement with the container and substantially conform to a lateral profile of the container to close said opening; and a mounting structure adapted to support the platform inclined from the horizontal whereby said one edge of the platform forms a lower edge of the platform, and the first and second walls are disposed proximate the lower edge and extend transversely and upwardly away from the platform.

17. The portable stand of claim 16 further including:

first and second laterally disposed end closure members integral with the support structure and disposed at opposite ends of the first and second walls, adapted to close opposite ends of the container when the support structure is in said surrounding engagement.

18. The portable stand of claim 16 wherein:

the support structure comprises a plurality of elongate panels, each panel having a longitudinal panel length and a lateral panel width, with the panels being arranged side-by-side and coupled rotatably to provide for a pivoting of adjacent panels relative to one another about longitudinal axes; and the support structure, when in said surrounding engagement with the container, forms an elongate cylinder that extends longitudinally and is polygonal in lateral cross section.

19. The portable stand of claim 18 wherein:

adjacent ones of the panels are hinged together.

20. The portable stand of claim 18 wherein:

confronting side edges of adjacent panels are disposed to engage one another when the support structure is in the substantially planar configuration, thereby restricting said pivoting of adjacent panels to a single direction angularly away from the planar configuration.

21. The portable stand of claim 16 wherein:

the mounting structure is collapsible and, when collapsed, fits inside the container.

22. The portable stand of claim 21 wherein:

the mounting structure includes a base, a column extending upwardly from the base, and a brace mounted to an upper end portion of the column and adapted for a removable coupling to the support structure.

23. The portable stand of claim 22 wherein:

the brace is pivotally coupled to the column and is moveable between an extended configuration for said removable coupling to the support structure and a collapsed configuration against the column.

24. The portable stand of claim 22 wherein:

the column is comprised of a plurality of telescoping column sections.

25. The portable stand of claim 22 wherein:

the base includes a plurality of legs moveable relative to the column between respective extended positions for supporting the column, and respective collapsed positions against the column.

26. The portable stand of claim 22 wherein:

said base and said brace are substantially permanently coupled to the column.

27. The portable stand of claim 16 wherein: said first wall and second wall extend away from the platform at respective first and second predetermined angles in the range of 45 degrees to 135 degrees.

28. The portable stand of claim 27 wherein:

each of said first and second predetermined angles is approximately 90 degrees.

29. The portable stand of claim 28 wherein:

the container is rectangular in lateral cross section.

30. In conjunction with a portable stand including a support structure disposed in a substantially planar configuration to provide a platform, a first wall extending in a longitudinal direction along a selected longitudinal edge of the platform and further extending laterally from the platform at a predetermined angle relative to the platform, at least one substantially laterally disposed end closure member having a lateral profile, and a mounting structure removeably coupled to the support structure for maintaining the platform at an incline from the horizontal; a process for stowing the stand, including:

disconnecting the mounting structure from the support structure;

collapsing the mounting structure into a stowage configuration;

placing the mounting structure, when in the stowage configuration, on the platform adjacent the first wall; and with the mounting structure so placed, turning the support structure about at least one longitudinal axis to form a containment structure substantially conforming to said lateral profile and at least partially surrounding the mounting structure and the first wall to maintain the mounting structure proximate the first wall.

31. The process of claim 30 wherein:

the support structure includes a plurality of elongate longitudinally extending panels arranged side-by-side and coupled rotatably to provide for a pivoting of adjacent panels relative to one another about longitudinal axes; and said forming the support structure about at least one longitudinal axis comprises so pivoting the adjacent panels, whereby the containment structure is polygonal in lateral cross section.

32. A music stand comprising:

a support structure adapted to assume a substantially planar configuration to provide a platform, and further adapted to alternatively assume a closed configuration in which the support structure is turned about at least one longitudinal axis;

an elongate first wall running lengthwise in the longitudinal direction along one edge of the support structure;

two substantially longitudinally spaced apart end closure members integral with the first wall, the end closure members having a lateral profile; and a mounting structure adapted for a releasable coupling to the support structure when in the planar configuration, to support the platform inclined from the horizontal with said one edge of the support structure forming a lower edge of the platform;

wherein the mounting structure is collapsible and, when collapsed and disconnected from the support structure, is positionable on the support structure near the first wall, and the support structure when assuming the closed configuration surrounds the end closure members and substantially conforms to the lateral profile and forms a longitudinally extending container adapted to maintain the collapsed mounting structure proximate the first wall.

* * * * *